US007268658B1

(12) United States Patent
Liang et al.

(10) Patent No.: US 7,268,658 B1
(45) Date of Patent: Sep. 11, 2007

(54) TRANSFORMER HAVING LEAKAGE INDUCTANCE CONTROL STRUCTURE

(75) Inventors: Shih-An Liang, Taoyuan Hsien (TW); Chia-Jung Tang, Taoyuan Hsien (TW); Chih-Ming Hu, Taoyuan Hsien (TW); Ching-Wen Huang, Taoyuan Hsien (TW)

(73) Assignee: SPI Electronic Co., Ltd., Taoyuan, Taoyuan Hsien (TW)

( * ) Notice: Subject to any disclaimer, the term of this patent is extended or adjusted under 35 U.S.C. 154(b) by 0 days.

(21) Appl. No.: 11/636,613

(22) Filed: Dec. 11, 2006

(30) Foreign Application Priority Data

Apr. 20, 2006 (TW) ..... 95206682 U

(51) Int. Cl.
*H01F 27/34* (2006.01)

(52) U.S. Cl. ..... 336/182; 336/208; 336/180

(58) Field of Classification Search ..... 336/212, 336/208, 198, 192, 180–182
See application file for complete search history.

(56) References Cited

U.S. PATENT DOCUMENTS 4,405,913 A * 9/1983 Finkbeiner ..... 336/98
4,549,130 A * 10/1985 Dobberstein ..... 323/308
4,968,106 A * 11/1990 Ikeuchi et al. ..... 315/411
6,449,178 B1 * 9/2002 Sakai et al. ..... 363/131
6,593,836 B1 * 7/2003 LaFleur et al. ..... 336/61
7,180,399 B2 * 2/2007 Chung ..... 336/212
2006/0158908 A1 * 7/2006 Usui ..... 363/15

* cited by examiner

*Primary Examiner*—Anh Mai
(74) *Attorney, Agent, or Firm*—Birch, Stewart, Kolasch & Birch, LLP

(57) ABSTRACT

A transformer having a leakage inductance control structure includes a primary coil, a secondary coil formed at a selected coil ratio relative to the primary coil to transform voltage and output electric power, and a leakage inductance control coil which is wound on the secondary coil in an insulation manner according to a selected coupling efficiency and electrically connected to the primary coil. Through electromagnetic coupling of the leakage inductance control coil and the secondary coil a power control signal is output and sent to the primary coil to control leakage inductance of the primary coil.

12 Claims, 8 Drawing Sheets

TRANSFORMER HAVING LEAKAGE INDUCTANCE CONTROL STRUCTURE

FIELD OF THE INVENTION

The present invention relates to a transformer and particularly to a transformer which has a leakage inductance control structure.

BACKGROUND OF THE INVENTION

Transformer is a frequently used electronic element in various types of electric equipment. FIG. 1 illustrates the structure of a conventional transformer 1 which includes a primary coil 10 and a secondary coil 11 spaced from the primary coil 10. The primary coil 10 and the secondary coil 11 generate electromagnetic coupling effect through an iron core 12 to transform voltage.

The primary coil 10 and the secondary coil 11 of the transformer 1 mentioned above are adjacent to each other, as a result the leakage inductance of the transformer 1 is higher that results in a greater energy loss during voltage transformation. To remedy this problem another type of transformer 2 has been developed as shown in FIG. 2. It adopts a three-layer winding structure (or called the transformer with sandwich winding). It has an upper layer, a middle layer and a lower layer to become respectively a first primary coil 20, a secondary coil 21 and a second primary coil 22. The primary coils 20 and 22 are not adjacent to the secondary coil 21, the leakage inductance is much smaller, and energy loss also is smaller.

However, when the two types of transformers previously discussed are coupled with an asymmetrical half bridge oscillation circuit, the leakage inductance is too large or too small to provide the leakage inductance needed by the asymmetrical half bridge oscillation circuit. Hence how to provide a transformer capable of controlling leakage inductance is an issue remained to be resolved in the industry.

SUMMARY OF THE INVENTION

The primary object of the present invention is to provide a transformer that is capable of controlling leakage inductance. It has a leakage inductance control coil to form an electromagnetic coupling with a secondary coil to output a power control signal to control the leakage inductance of the primary coil.

To achieve the foregoing object, the transformer according to the invention includes a primary coil, a secondary coil formed at a selected coil ratio relative to the primary coil to transform voltage and output electric power, and a leakage inductance control coil which is wound on the secondary coil in an insulation manner according to a selected coupling efficiency and electrically connected to the primary coil. Through electromagnetic coupling of the leakage inductance control coil and the secondary coil a power control signal is output and sent to the primary coil to control the leakage inductance of the primary coil.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
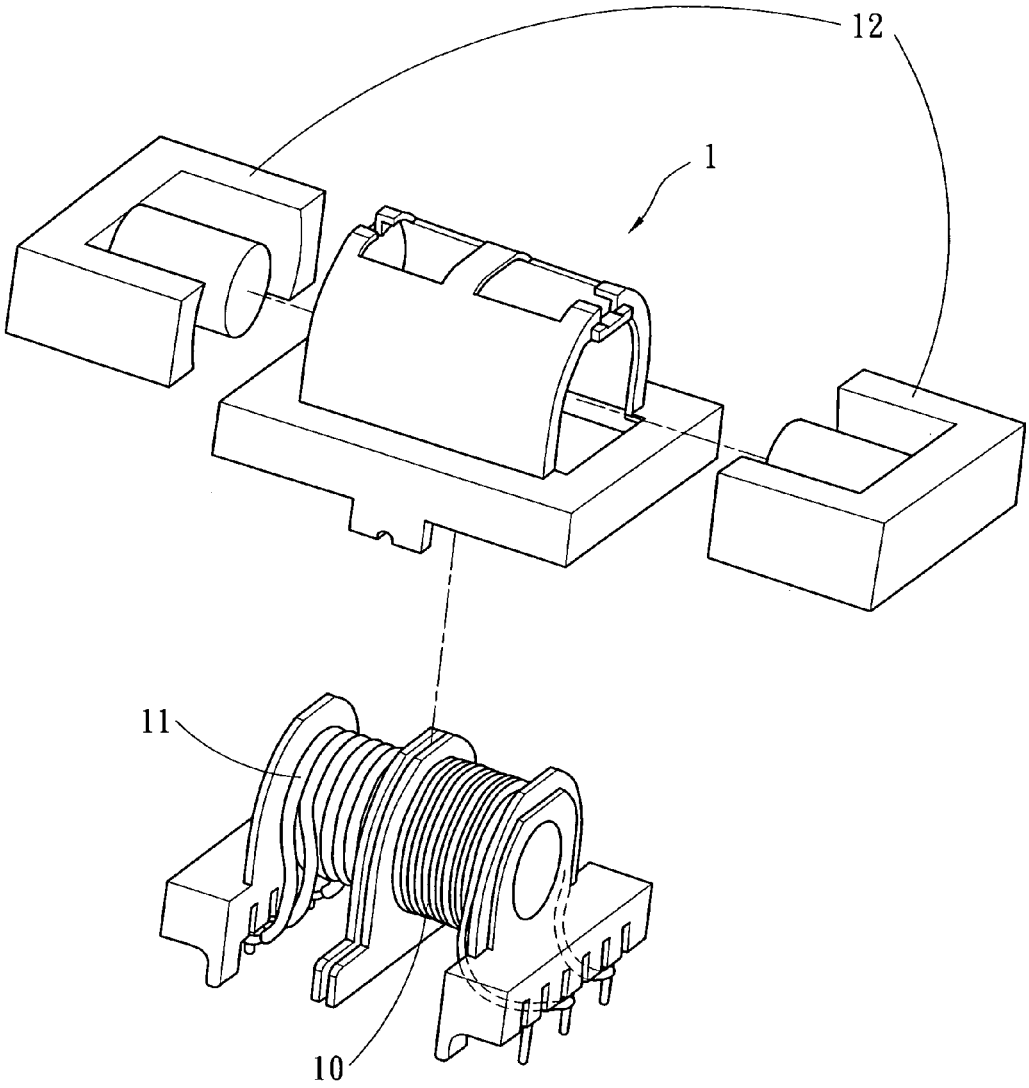
Fig. 1 PRIOR ART
FIG. 1 is an exploded view of a conventional transformer.
Figure 2:
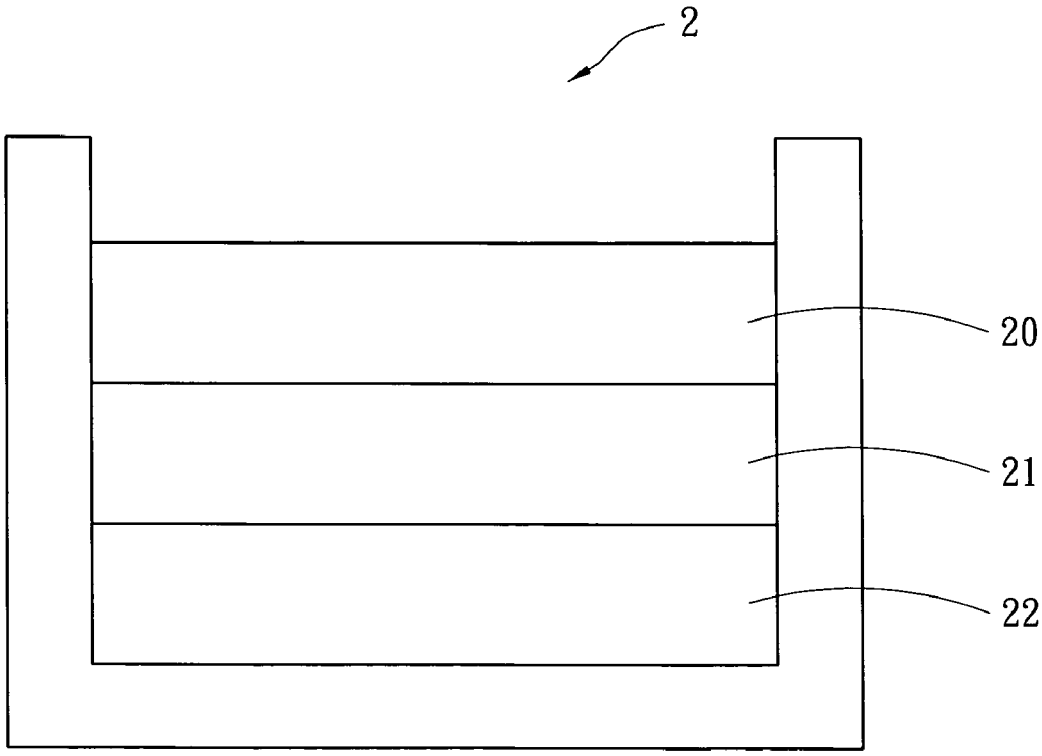
Fig. 2 PRIOR ART
FIG. 2 is a fragmentary schematic view of another conventional transformer.
Figure 3A:
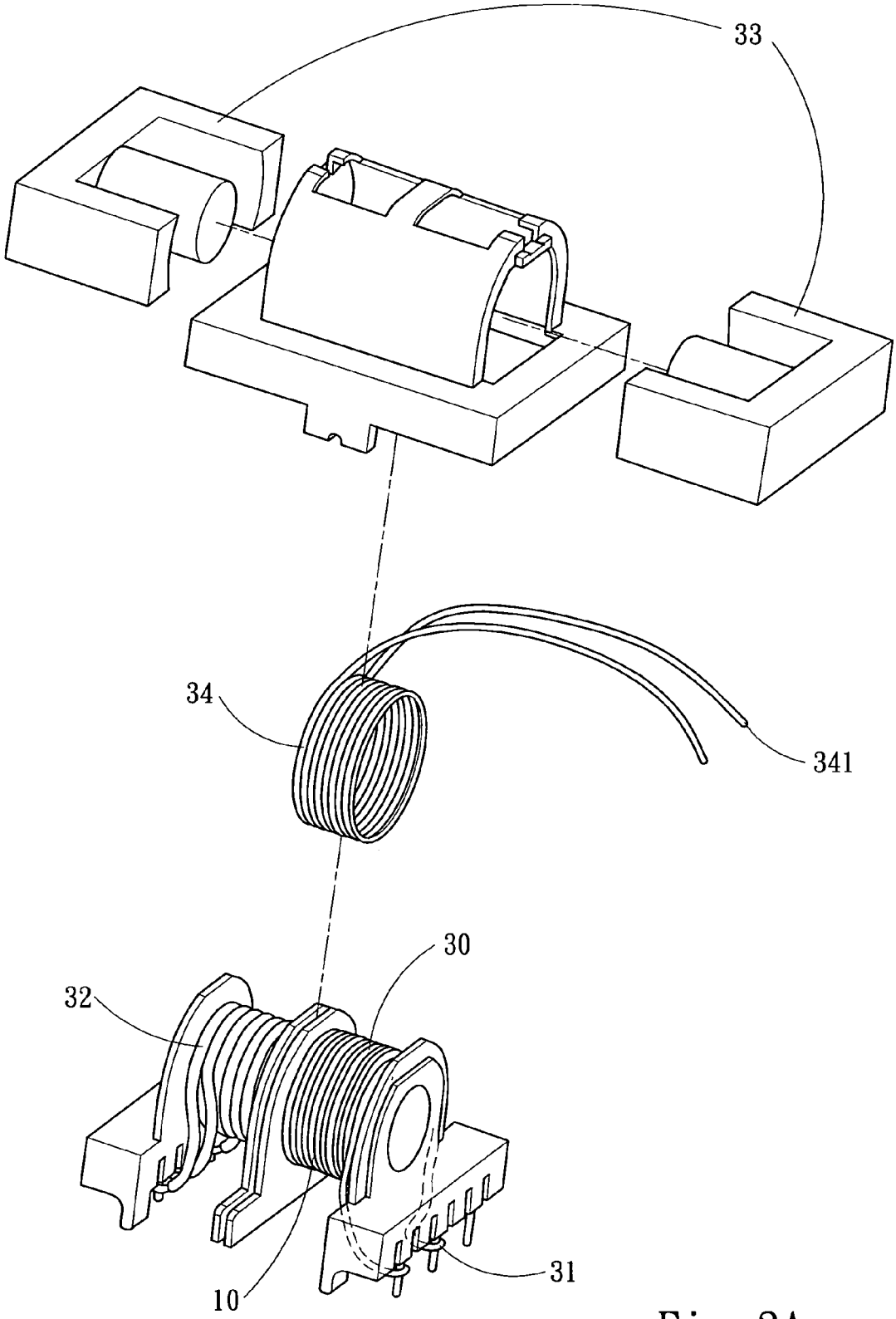
FIG. 3A is an exploded view of a first embodiment of the invention.
Figure 3B:
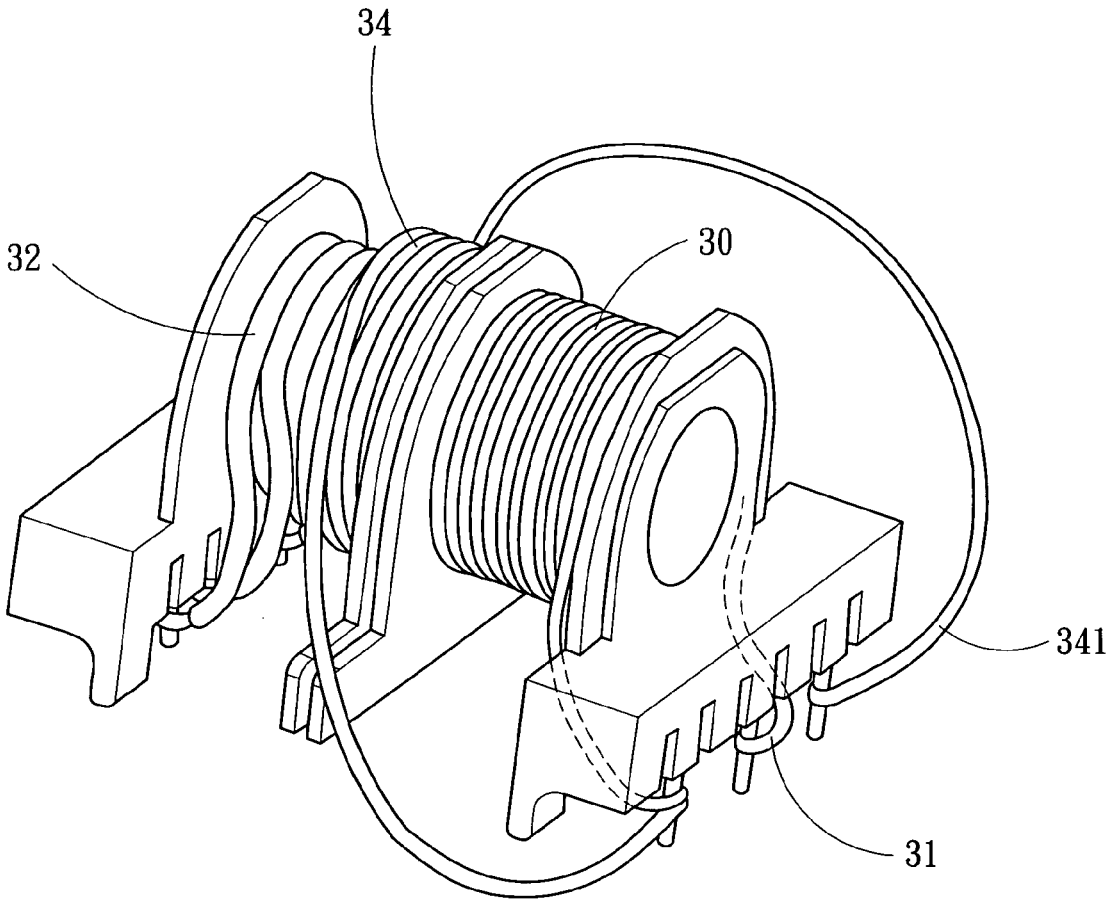
FIG. 3B is a sectional exploded perspective view of the first embodiment of the invention.
Figure 4:
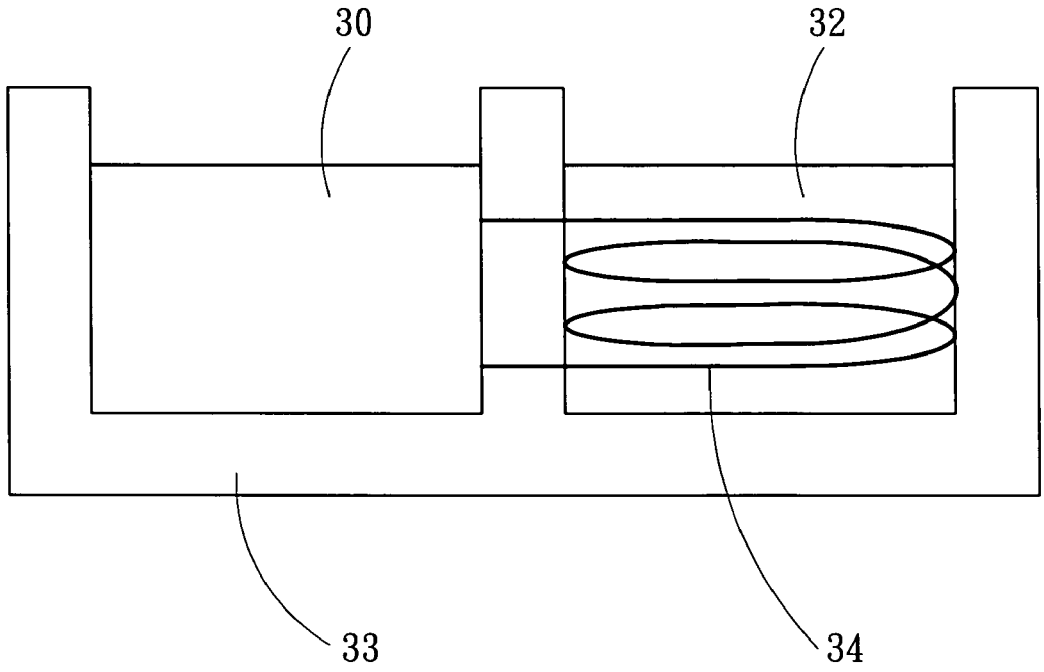
FIG. 4 is a schematic view of the first embodiment of the invention.

Please refer to FIGS. 3A, 3B and 4 for a first embodiment of the invention. The transformer equipped with a leakage inductance control structure of the invention includes:

a primary coil 30;

a secondary coil 32 wound at a selected coil ratio relative to the primary coil 30 to transform voltage and output power. The primary coil 30 and the secondary coil 32 generate an electromagnetic coupling efficiency through an iron core 33. In this embodiment the primary coil 30 is spaced from the secondary coil 32; and a leakage inductance control coil 34 which is wound on the secondary coil 32 in an insulation manner according to a selected coupling efficiency and electrically connected to the primary coil 30. Through electromagnetic coupling of the leakage inductance control coil 34 and the secondary coil 32 a power control signal is output and sent to the primary coil 30 to control the leakage inductance of the primary coil 30. In this embodiment the primary coil 30 and the leakage inductance control coil 34 are formed respectively on two conductive wires that have respectively a terminal end 31 and a wire end 341 to allow the primary coil 30 and the leakage inductance control coil 34 to be connected in series to transmit the power control signal. The leakage inductance control coil 34 straddles the primary coil 30 and is wound on the secondary coil 32.

It is to be noted that in this embodiment the primary coil 30 and the leakage inductance control coil 34 are formed on two conductive wires. But in practice the primary coil 30 and the leakage inductance control coil 34 may also be formed on one conductive wire which has a portion serving as the primary coil 30 and the rest portion as the leakage inductance control coil 34. Moreover, the insulation winding of the leakage inductance control coil 34 over the secondary coil 34 may be accomplished by forming an insulation layer on either the secondary coil 32 or the leakage inductance control coil 34, while the other is a bare copper wire, or by forming an insulation layer on both. In the last situation the electromagnetic coupling efficiency is less desirable.

By means of the aforesaid structure, the coil number of the leakage inductance control coil 34 wound on the secondary coil 32 may be selected according to the coupling efficiency required by users. If the required coupling efficiency is higher, the coil number of the leakage inductance control coil 34 also is greater. Similarly a lower coupling efficiency needs a smaller number of coil on the leakage inductance control coil 34. Through the electromagnetic coupling of the leakage inductance control coil 34 of a set coil number and the secondary coil 32, the leakage inductance of the primary coil 30 can be controlled.

Figure 5:
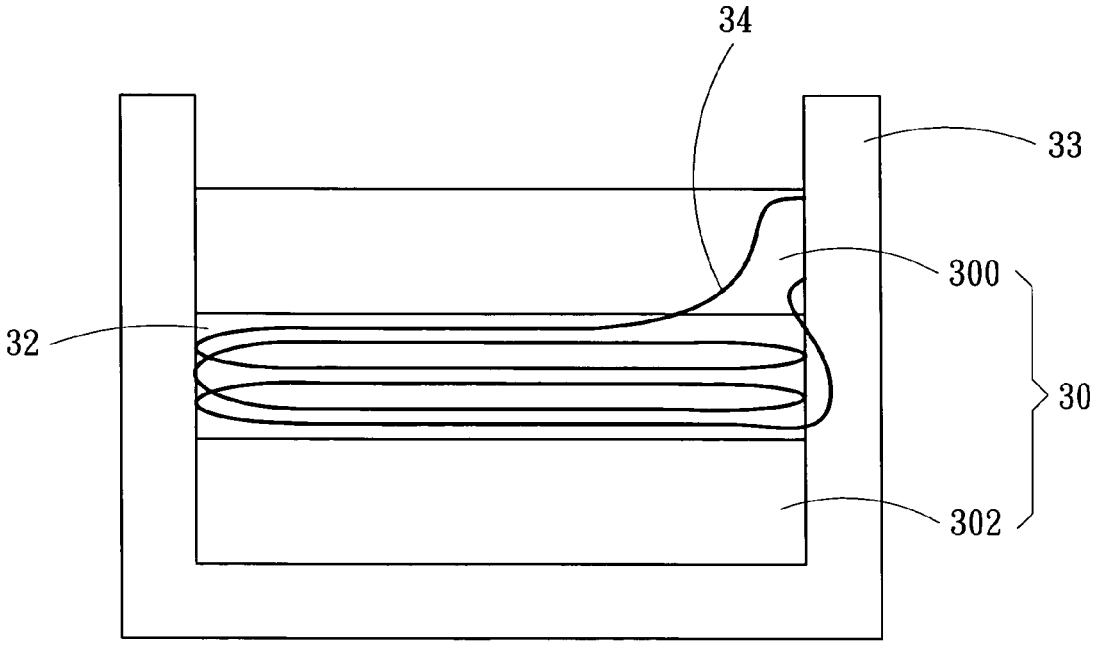
FIG. 5 is a schematic view of a second embodiment of the invention.

Refer to FIG. 5 for a second embodiment of the invention. It is a transformer adopting a three-layer winding structure. The primary coil 30 has a first primary coil 300 and a second primary coil 302. The secondary coil 32 is interposed between the first primary coil 300 and the second primary coil 302. The leakage inductance control coil 34 is wound on the secondary coil 32 and is electrically connected to the first primary coil 300. The leakage inductance control coil 34 and the primary coil 30 are formed on different conductive wires. The leakage inductance control coil 34 is electrically connected to the first primary coil 300 to transmit the power control signal.

It is to be noted that in the second embodiment previously discussed, the leakage inductance control coil 34 is electrically connected to the first primary coil 300 in series. In practice, the leakage inductance control coil 34 may also be electrically connected to the second primary coil 302 in series, or have two ends connecting to the first primary coil 300 and the second primary coil 302 in series to transmit the power control signal.

In the three-layer transformer set forth above the coil number of the leakage inductance control coil 34 wound on the secondary coil 32 also may be determined according to the coupling efficiency required by the users. Through the electromagnetic coupling of the leakage inductance control coil 34 and the secondary coil 32, the leakage inductance of the primary coil 30 can be controlled.

Figure 6:
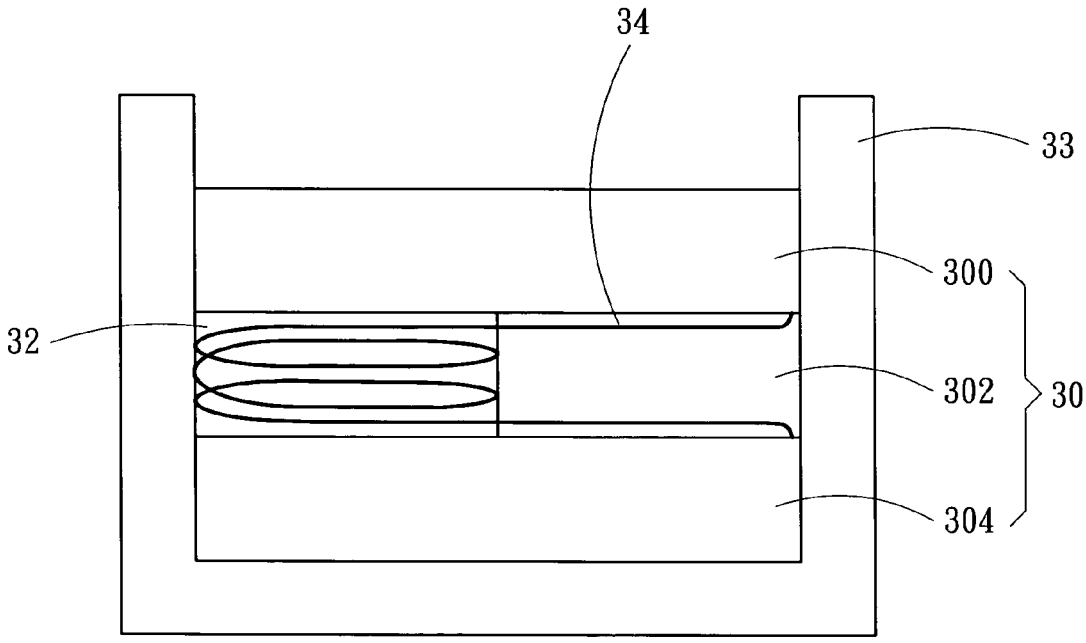
FIG. 6 is a schematic view of a third embodiment of the invention.

Refer to FIG. 6 for a third embodiment of the invention. In this embodiment the primary coil 30 consists of a first primary coil 300, a second primary coil 302 and a third primary coil 304 that are electrically connected and laid in an upper, middle and lower manner. The secondary coil 32 is located on one side of the second primary coil 302. The leakage inductance control coil 34 straddles the wire ends of the second primary coil 302 and is wound on the secondary coil 32 in an insulation manner. The leakage inductance control coil 34 and the second primary coil 302 have wire ends twisted and connected in series to transmit the power control signal.

It is to be noted that in this embodiment the leakage inductance control coil 34 is connected to the wire ends of the second primary coil 302 in a straddle fashion and is wound on the secondary coil 32 in an insulation manner. In practice, the leakage inductance control coil 34 may also be connected to the wire ends of the first primary coil 300 or the third primary coil 304 in a straddle fashion to achieve the desired electromagnetic coupling. By twisting and connecting the leakage inductance control coil 34 with either or any combination of the first primary coil 300, the second primary coil 302 and the third primary coil 304 in series the power control signal can be transmitted.

Because the first primary coil 300 and the third primary coil 304 generate a smaller amount of leakage inductance against the secondary coil 32, and the second primary coil 302 generates a greater amount of leakage inductance against the secondary coil 32, users can choose any one or any combination of the first primary coil 300, second primary coil 302 and third primary coil 304 to connect electrically to the leakage inductance control coil 34 according to the required coupling efficiency.

Figure 7:
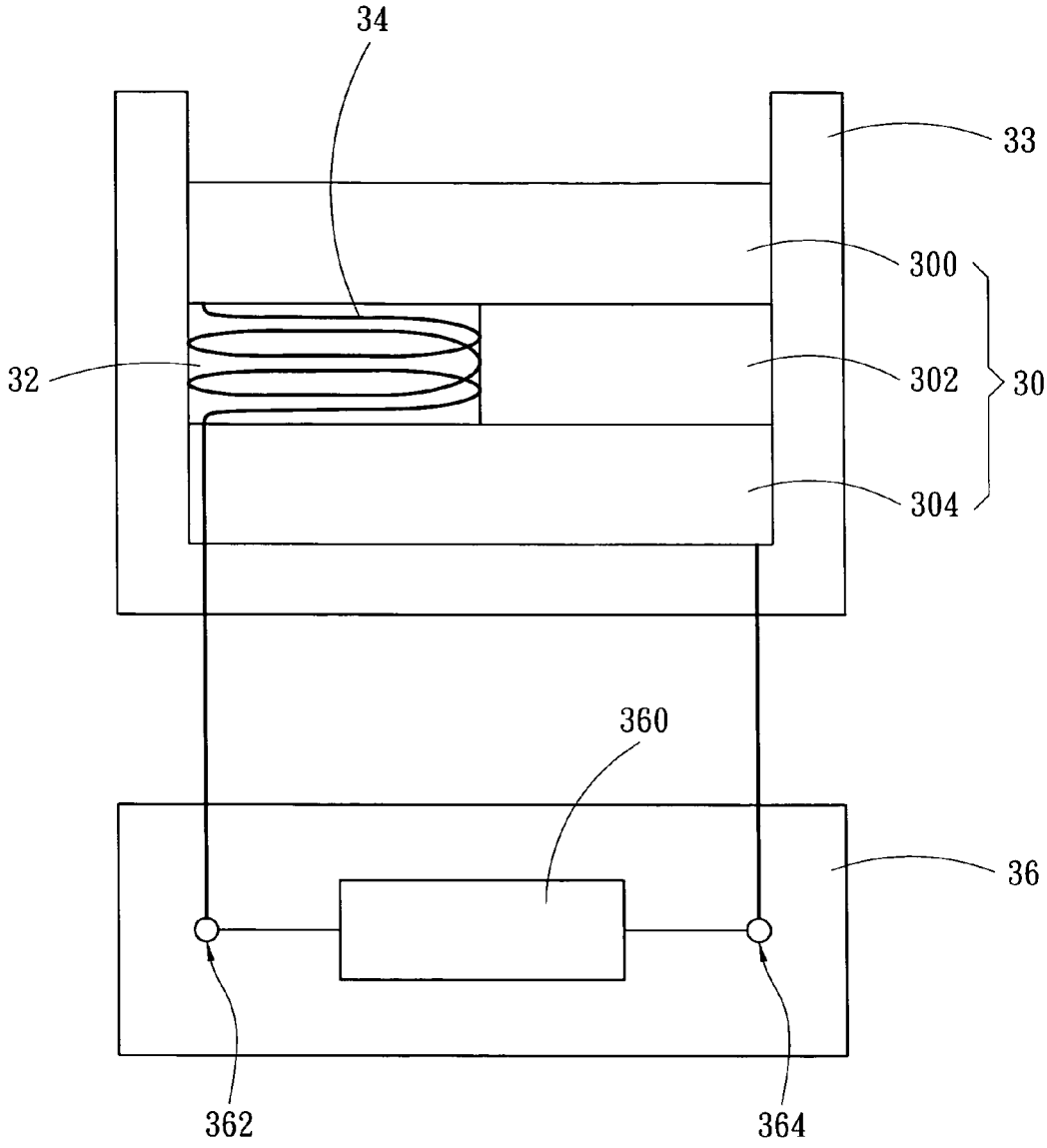
FIG. 7 is a schematic view of a fourth embodiment of the invention.

Refer to FIG. 7 for a fourth embodiment of the invention. It is an extension of the third embodiment previously discussed. In this embodiment the primary coil 30 also consists of a first primary coil 300, a second primary coil 302 and a third primary coil 304 that are electrically connected and laid in an upper, middle and lower manner. The secondary coil 32 also is located on one side of the second primary coil 302. The leakage inductance control coil 34 is connected to the wire ends of the second primary coil 302 in series in a straddle fashion and is wound on the secondary coil 32 in an insulation manner.

It differs from the third embodiment by connecting the primary coil 30 to one end 362 of an internal transmission circuit 360 of a circuit board 36. The leakage inductance control coil 34 is connected to another end 364 of the internal transmission circuit 360. The power control signal is transmitted through the internal transmission circuit 360.

Therefore the leakage inductance control coil 34 can be electrically connected to any one or any combination of the first primary coil 300, second primary coil 302 and third primary coil 304 through the internal transmission circuit 360 of the circuit board 36.

In short, the invention outputs the power control signal through electromagnetic coupling of the leakage inductance control coil 34 and the secondary coil 32 to control leakage inductance of the primary coil 30. Users can set the winding coil number of the leakage inductance control coil 34 according to coupling efficiency, thereby to regulate the power control signal and determine the leakage inductance of the primary coil 30. Thus the design of the leakage inductance control coil 34 and the secondary coil 32 of the invention can be adopted to any type of transformer to get the required leakage inductance, and provide leakage inductance required by an asymmetrical half bridge oscillation circuit. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A transformer having a leakage inductance control structure, comprising:

a primary coil;

a secondary coil wound at a selected ratio of coil number relative to the primary coil to transform voltage and output power; and a leakage inductance control coil which is wound on the secondary coil in an insulation manner according to a selected coupling efficiency and electrically connected to the primary coil;

wherein the leakage inductance control coil and the secondary coil form an electromagnetic coupling to output a power control signal which is sent to the primary coil to control leakage inductance thereof.

2. The transformer having the leakage inductance control structure of claim 1, wherein the primary coil and the leakage inductance control coil are formed on a same conductive wire.

3. The transformer having the leakage inductance control structure of claim 1, wherein the primary coil and the leakage inductance control coil are formed on two different conductive wires.

4. The transformer having the leakage inductance control structure of claim 1, wherein the secondary coil is surrounded by an insulation layer and the leakage inductance control coil is formed by a bare copper wire.

5. The transformer having the leakage inductance control structure of claim 1, wherein the leakage inductance control coil is surrounded by an insulation layer and the secondary coil is formed by a bare copper wire.

6. The transformer having the leakage inductance control structure of claim 1, wherein the leakage inductance control coil and the secondary coil are surrounded respectively by an insulation layer.

7. The transformer having the leakage inductance control structure of claim 1, wherein the primary coil includes a first primary coil and a second primary coil, the secondary coil being interposed between the first primary coil and the second primary coil, the leakage inductance control coil being wound on the secondary coil and electrically connected to the first primary coil.

8. The transformer having the leakage inductance control structure of claim 1, wherein the primary coil includes a first primary coil and a second primary coil, the secondary coil being interposed between the first primary coil and the second primary coil, the leakage inductance control coil being wound on the secondary coil and electrically connected to the second primary coil.

9. The transformer having the leakage inductance control structure of claim 1, wherein the primary coil includes a first primary coil and a second primary coil, the secondary coil being interposed between the first primary coil and the second primary coil, the leakage inductance control coil being wound on the secondary coil and electrically connected to the first primary coil and the second primary coil.

10. The transformer having the leakage inductance control structure of claim 1, wherein the primary coil includes a first primary coil, a second primary coil and a third primary coil that are laid in an upper, a middle and a lower manner and electrically connected to one another, the leakage inductance control coil being connected to wire ends of the second primary coil in a straddle fashion and wound on the secondary coil adjacent to the second primary coil in an insulation manner.

11. The transformer having the leakage inductance control structure of claim 1, wherein the primary coil is spaced from the secondary coil, the leakage inductance control coil straddling the primary coil and being wound on the secondary coil.

12. The transformer having the leakage inductance control structure of claim 1, wherein the primary coil is connected to one end of an internal transmission circuit of a circuit board and the leakage inductance control coil is connected to another end of the internal transmission circuit which transmits the power control signal.

* * * * *